US008506318B2

(12) United States Patent
Liao et al.

(10) Patent No.: US 8,506,318 B2
(45) Date of Patent: Aug. 13, 2013

(54) CONNECTOR MODULE AND ELECTRONIC DEVICE USING THE SAME

(75) Inventors: Chih-Cheng Liao, Taipei (TW); Kuo-Wei Tsao, Taipei (TW); Kuan-Ting Chen, Taipei (TW); Yu-Wei Su, Taipei (TW); Min-Hua Hsu, Taipei (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 13/344,130

(22) Filed: Jan. 5, 2012

(65) Prior Publication Data

US 2012/0178281 A1 Jul. 12, 2012

(30) Foreign Application Priority Data

Jan. 11, 2011 (TW) ..... 100101012 A

(51) Int. Cl.
*H01R 13/627* (2006.01)

(52) U.S. Cl.
USPC ..... 439/349

(58) Field of Classification Search
USPC ..... 439/349, 350, 860, 490, 338, 341
See application file for complete search history.

(56) References Cited

U.S. PATENT DOCUMENTS 3,750,094 A * 7/1973 Zenkich ..... 439/733.1
4,056,299 A * 11/1977 Paige ..... 439/439
4,597,620 A * 7/1986 Lindner et al. ..... 439/277
5,176,533 A * 1/1993 Sakurai et al. ..... 439/352
5,277,614 A * 1/1994 Bentz et al. ..... 439/350
6,676,455 B2 * 1/2004 Machado ..... 439/855
6,692,286 B1 * 2/2004 De Cet ..... 439/352
6,848,930 B2 * 2/2005 Fukuda ..... 439/349
7,500,873 B1 * 3/2009 Hart ..... 439/578
8,079,880 B2 * 12/2011 Lin et al. ..... 439/668
2002/0173193 A1 * 11/2002 Nishimoto ..... 439/349

FOREIGN PATENT DOCUMENTS

JP 07-005819 1/1995
JP 2000-068339 3/2000

OTHER PUBLICATIONS

English language translation of abstract of JP 2000-068339, Mar. 3, 2000.
English language translation of abstract of JP 07-005819, Jan. 10, 1995.

* cited by examiner

*Primary Examiner* — Gary F. Paumen
(74) *Attorney, Agent, or Firm* — McClure, Qualey & Rodack, LLP

(57) ABSTRACT

A connector module includes a first connector, a first electrode, a second connector and a second electrode. The first connector has a plug hole. The first electrode is disposed in the plug hole. The second connector has a connecting portion. A projecting area of the connecting portion is larger than that area of the plug hole. The second electrode is disposed at the connecting portion. When the connecting portion is disposed in the first connector, the first electrode contacts the second electrode and an inner wall of the plug hole restrains the connecting portion from detaching from the plug hole. An electronic device with the connector module is also disclosed herein.

6 Claims, 9 Drawing Sheets

CONNECTOR MODULE AND ELECTRONIC DEVICE USING THE SAME

RELATED APPLICATIONS

This application claims priority to Taiwan Application Serial Number 100101012, filed Jan. 11, 2011, which is herein incorporated by reference.

BACKGROUND OF THE INVENTION

1. Field of the Invention

The invention relates to a connector module and, more particularly, to a connector module for an electronic device.

2. Description of the Related Art

As science technology develops, various electronic devices, such as a notebook computer, a personal digital assistant (PDA), a mobile phone, a digital camera or a gaming device such as a game boy, are launched to make life more convenient. Since rated voltages of the electronic devices set by the manufacturers are different, the electronic devices have dedicated power adaptors. Usually, host of the electronic device includes a connector connecting with the connector in the power adaptor. In other words, a connector is essential for the host of the electronic device and the power adaptor.

BRIEF SUMMARY OF THE INVENTION

A connector module and an electronic device using the connector module are provided.

A connector module includes a first connector, a first electrode, a second connector and a second electrode. The first connector includes a plug hole. The first electrode is disposed in the plug hole. The second connector includes a connecting portion. Projecting area of the connecting portion is larger than that of the plug hole. The second electrode is disposed at the connecting portion. If the user wants to make the first electrode of the first connector contact the second electrode of the second connector, the connecting portion of the second connector is abutted against the plug hole of the first connector in any angle, and then the first connector is pressed to make the connecting portion of the second connector inserted into the plug hole. In the pressing, the edge of the plug hole deforms and expands outwards, so the connecting portion of the second connector can be pushed into the plug hole. After the connecting portion is pushed into the plug hole, the edge of the plug hole generates an elastic restoring force to make the plug hole restore, and the plug hole wraps the connecting portion. When the connecting portion of the second connector is disposed in the first connector, the first electrode contacts the second electrode, and an inner wall of the plug hole restrains the connecting portion from detaching from the plug hole.

An electronic device includes a host, a power adaptor, a first connector, a first electrode, a second connector and a second electrode. The first connector is selectively disposed at one of the host and the power adaptor, and the second connector is selectively disposed at the other one of the host and the power adaptor. The first connector includes a plug hole. The first electrode is disposed in the plug hole. The second connector includes a connecting portion. A projecting area of the connecting portion is larger than that of the plug hole. The second electrode is disposed at the connecting portion. If the user wants to make the first electrode of the first connector contact the second electrode of the second connector, the connecting portion of the second connector is abutted against the plug hole of the first connector in any angle, and then the first connector is pressed to make the connecting portion of the second connector inserted into the plug hole. In the pressing, the edge of the plug hole deforms and expands outwards, so the connecting portion of the second connector can be pushed into the plug hole. After the connecting portion is pushed into the plug hole, the edge of the plug hole generates an elastic restoring force to make the plug hole restore, and the plug hole wraps the connecting portion. When the connecting portion of the second connector is disposed in the first connector, the first electrode contacts the second electrode, and an inner wall of the plug hole restrains the connecting portion from detaching from the plug hole.

In practical usage, both the plug hole of the first connector and the connecting portion of the second connector may be annular-shaped, which is not limited herein.

A connector module includes a first connector, a first electrode, a second connector and a second electrode. The first electrode is disposed in the first connector, and the second electrode is disposed at the second connector. The first connector includes a plurality of elastic elements, and the second connector is pushed into the first connector via the elastic elements to make the first electrode contact the second electrode.

Elastic means include the second connector is abutted against the edge of the first connector in any angle. When an external force is applied to the second connector towards the first connector, the edge of the first connector elastically expands due to the press from the second connector, so as to make the second connector inserted into the first connector. After the second connector is pushed into the first connector, the second connector can rotate for 360 degrees relative to the first connector, and the second connector may also be detached from the first connector via the elastic means. According to the elastic mean in another example, the second connector is pulled in any angle relative to the first connector, and the edge of the first connector elastically expands due to the press from the second connector, so that the second connector is detached from the first connector.

These and other features, aspects and advantages of the present invention will become better understood with regard to the following description, appended claims, and accompanying drawings.

DETAILED DESCRIPTION OF THE EMBODIMENTS

Figure 1:
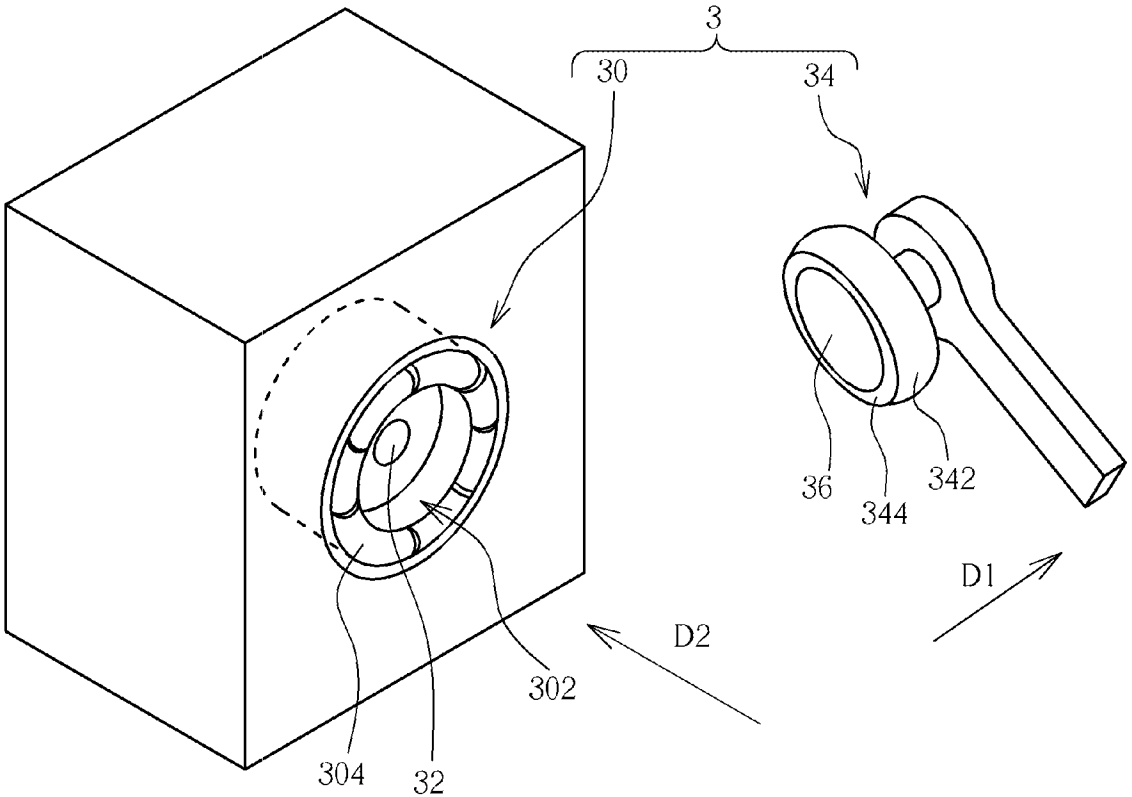
FIG. 1 is a schematic diagram showing a connector module in a first embodiment.
Figure 2:
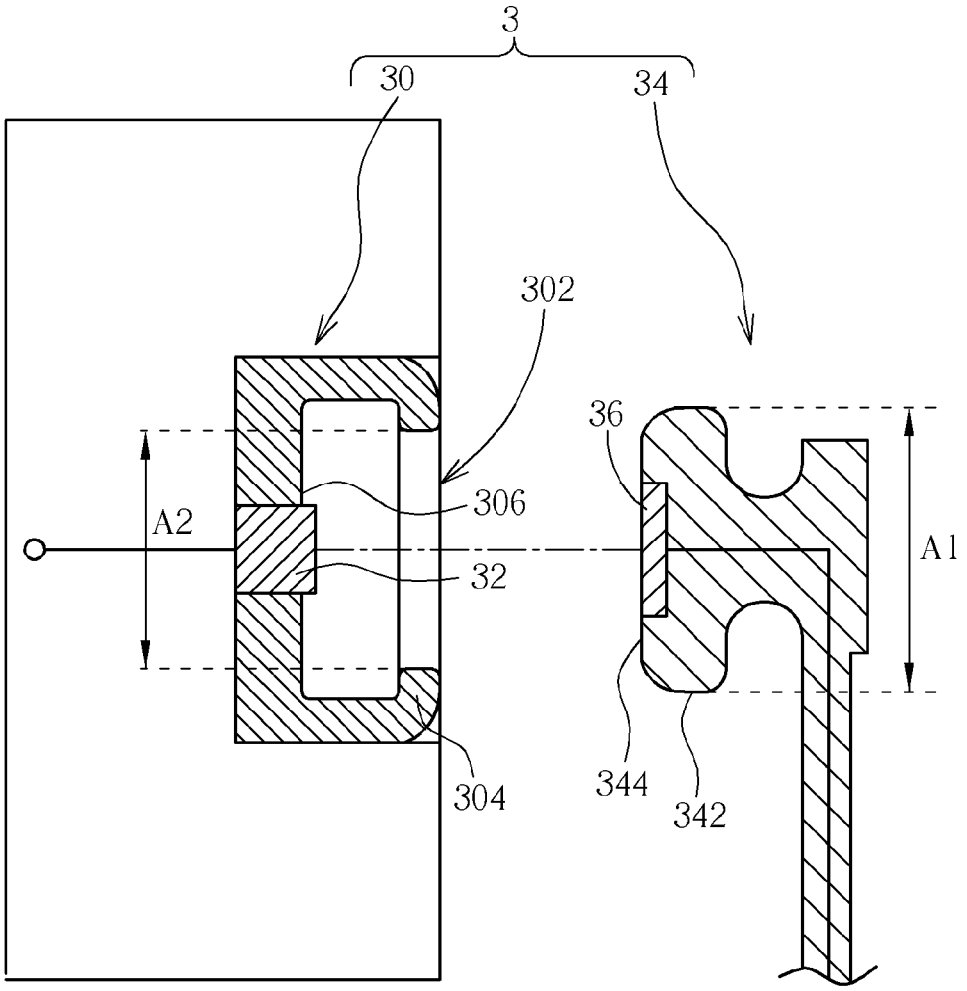
FIG. 2 is a sectional schematic diagram showing the connector module in FIG. 1 before assembly.
Figure 3:
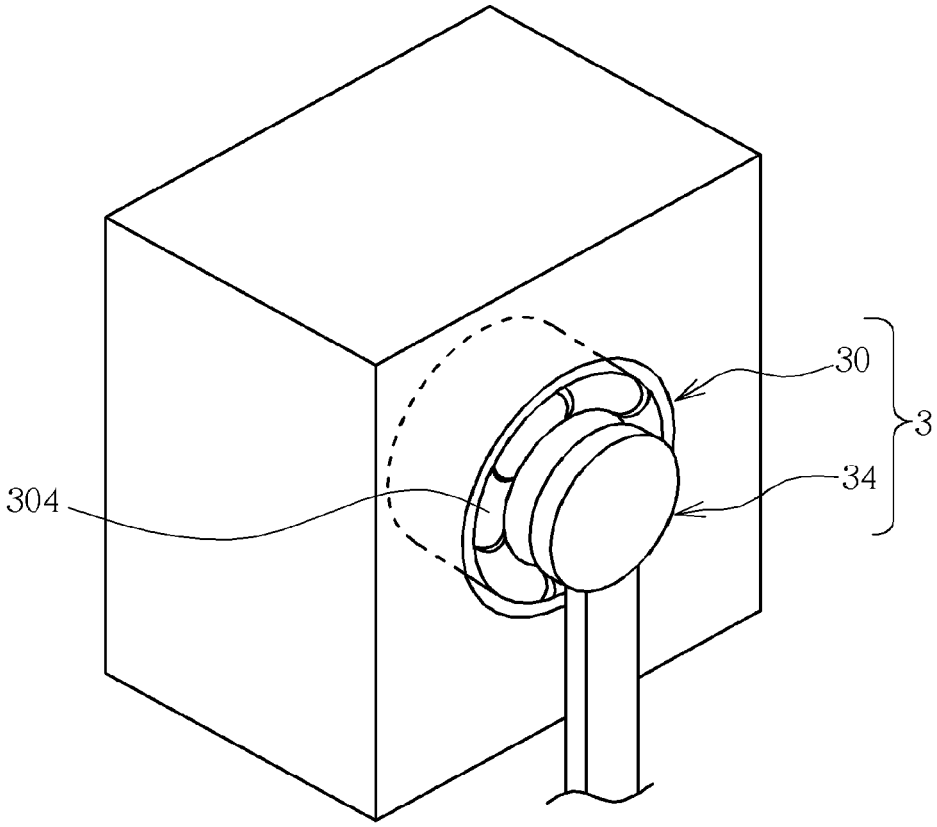
FIG. 3 is a schematic diagram showing the connector module in FIG. 1 after assembly.
Figure 4:
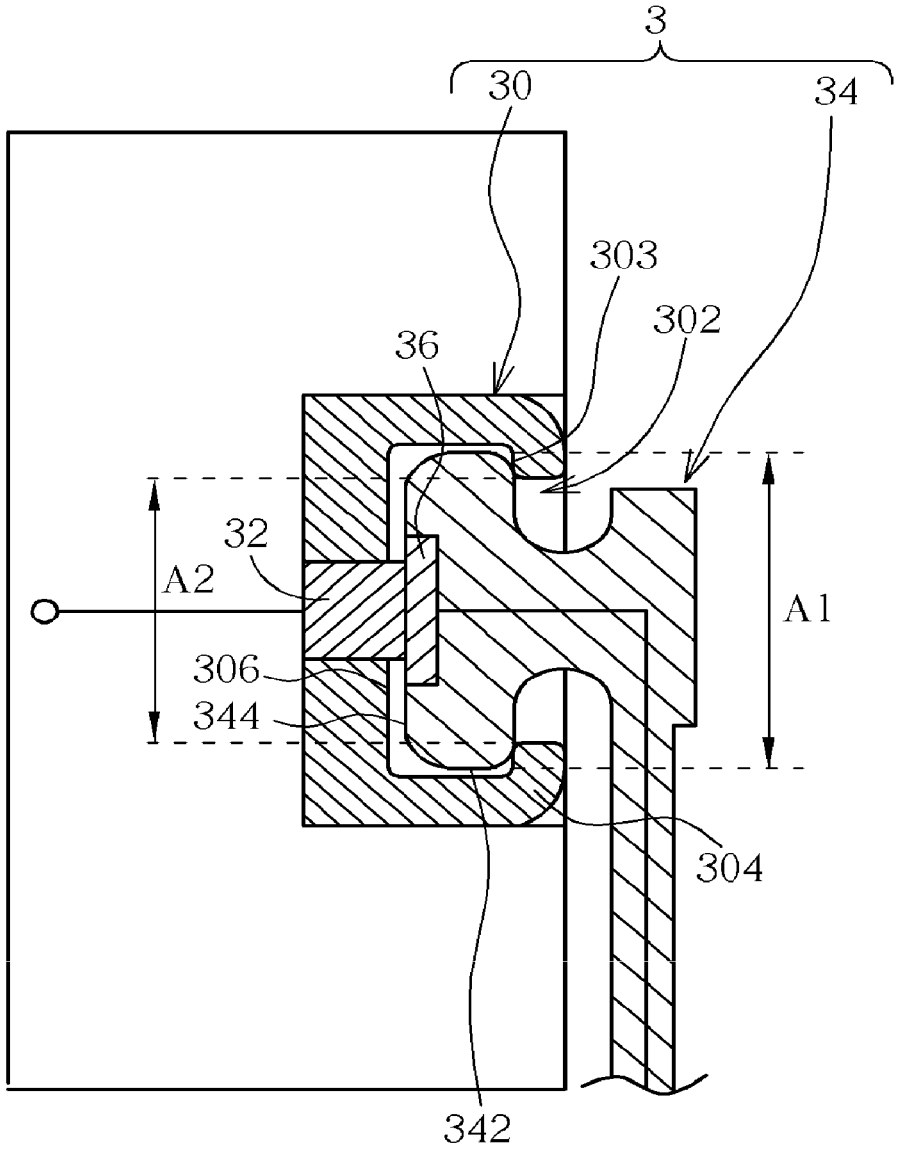
FIG. 4 is a sectional schematic diagram showing the connector module in FIG. 3.

FIG. 1 is a schematic diagram showing a connector module 3 in a first embodiment, FIG. 2 is a sectional schematic diagram showing the connector module 3 in FIG. 1 before assembly, FIG. 3 is a schematic diagram showing the connector module 3 in FIG. 1 after assembly, and FIG. 4 is a sectional schematic diagram showing the connector module 3 in FIG. 3. In FIG. 1, the connector module 3 includes a first connector 30, a first electrode 32, a second connector 34 and a second electrode 36. The first connector 30 includes a plug hole 302. The first connector 30 may include a plurality of elastic elements 304, and the plug hole 302 is surrounded by the elastic elements 304. The elastic elements 304 may be metal elastic sheets, which is not limited herein. The first electrode 32 is disposed at bottom 306 of the plug hole 302. The second connector 34 includes a connecting portion 342. The second electrode 36 is disposed at the top 344 of the connecting portion 342.

In an embodiment, the plug hole 302 of the first connector 30 and the connecting portion 342 of the second connector 34 may be in annular shape, which is not limited herein.

In FIG. 1 and FIG. 2, projecting area A1 of the connecting portion 342 viewed from D1 direction is larger than area A2 of the plug hole 302 viewed from D2 direction. If the user wants to contact the first electrode 32 of the first connector 30 to the second electrode 36 of the second connector 34, the user can make the connecting portion 342 of the second connector 34 abut against the plug hole 302 of the first connector 30 in any angle, and then the user can press the first connector 30 to insert the connecting portion 342 of the second connector 34 into the plug hole 302. The elastic elements 304 deform and expand outwards when the first connector 30 is pressed, and thus the connecting portion 342 of the second connector 34 can be pushed into the plug hole 302.

After the connecting portion 342 is pushed into the plug hole 302, the elastic elements 304 restore due to an elastic restoring force, and the plug hole 302 wraps the connecting portion 342. In FIG. 4, when the connecting portion 342 of the second connector 34 is held in the plug hole 302 of the first connector 30, the first electrode 32 contacts the second electrode 36, and an inner wall 303 of the plug hole 302 restrains the connecting portion 342 from detaching from the plug hole 302.

On the contrary, if the user wants to detach the second connector 34 from the first connector 30, the user can pull the second connector 34 in any angle. The elastic elements 304 deform and expand outwards, so the connecting portion 342 of the second connector 34 is detached from the plug hole 302. Then, the elastic elements 304 restore due to an elastic restoring force.

The top 344 of the connecting portion 342 may be a plane 平坦狀 to increase the contact area between the second electrode 36 and the first electrode 32. The top 344 of the connecting portion 342 may also be arc-shaped or concave-shaped.

In FIG. 4, when the connecting portion 342 of the second connector 34 is disposed in the plug hole 302 of the first connector 30, the projecting area A1 of the connecting portion 342 is larger than the area A2 of the plug hole 302, and the connecting portion 342 can rotates for 360 degrees in the plug hole 302. If the first connector 30 or the second connector 34 is pulled by an external force in an angle, the connecting portion 342 can pop out of the plug hole 302, and the first connector 30 is detached from the second connector 34. Thus, it can avoid that the first connector 30 and the second connector 34 are damaged due to the pull.

Figure 5:
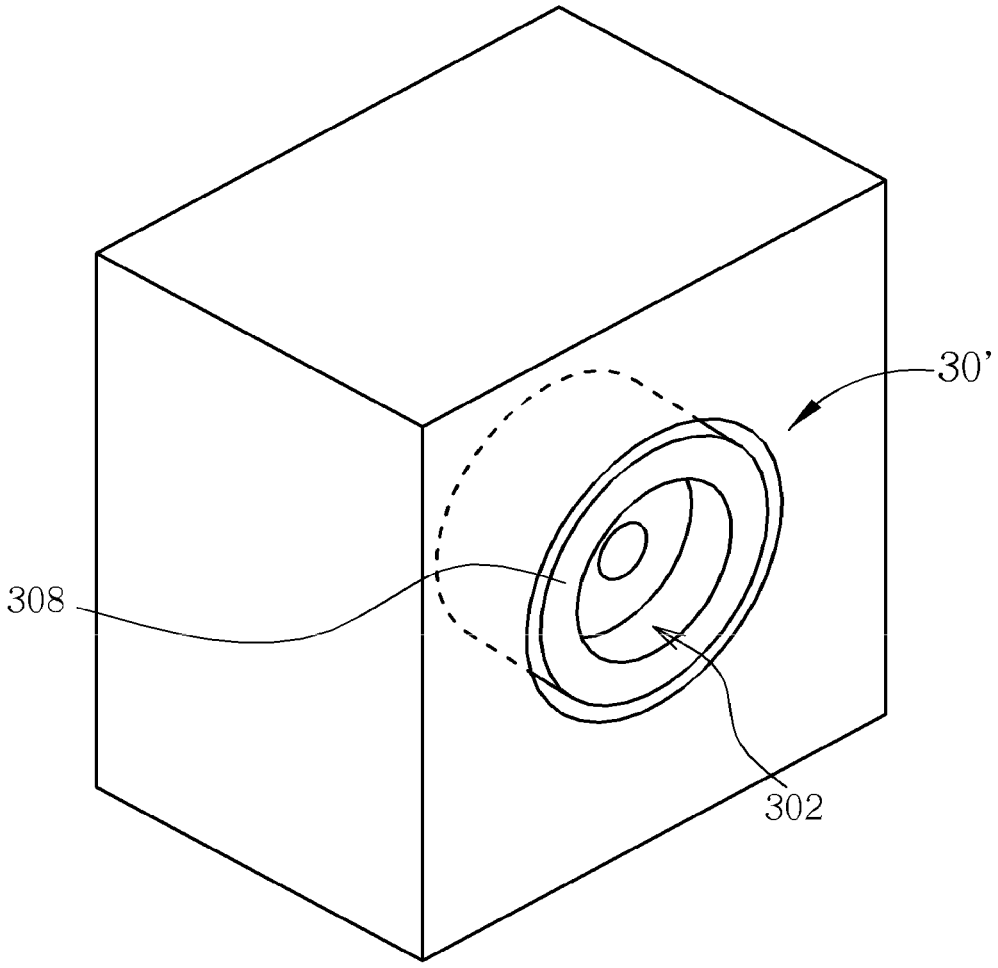
FIG. 5 is a schematic diagram showing a first connector in a second embodiment.

FIG. 5 is a schematic diagram showing a first connector 30' in a second embodiment. The main difference between the first connector 30' and the first connector 30 is that the first connector 30' may be made of elastic material (such as rubber). Thus, the plug hole 302 is formed by a continuous side wall 308, as shown in FIG. 5. Since the side wall 308 of the first connector 30' is characterized in elastic, when the connecting portion 342 of the second connector 34 is pushed into or pulled out of the plug hole 302 of the first connector 30', the plug hole 302 expands outwards. After the connecting portion 342 passes through the plug hole 302, the side wall 308 of the first connector 30' generates an elastic restoring force to restore the plug hole 302.

Figure 6:
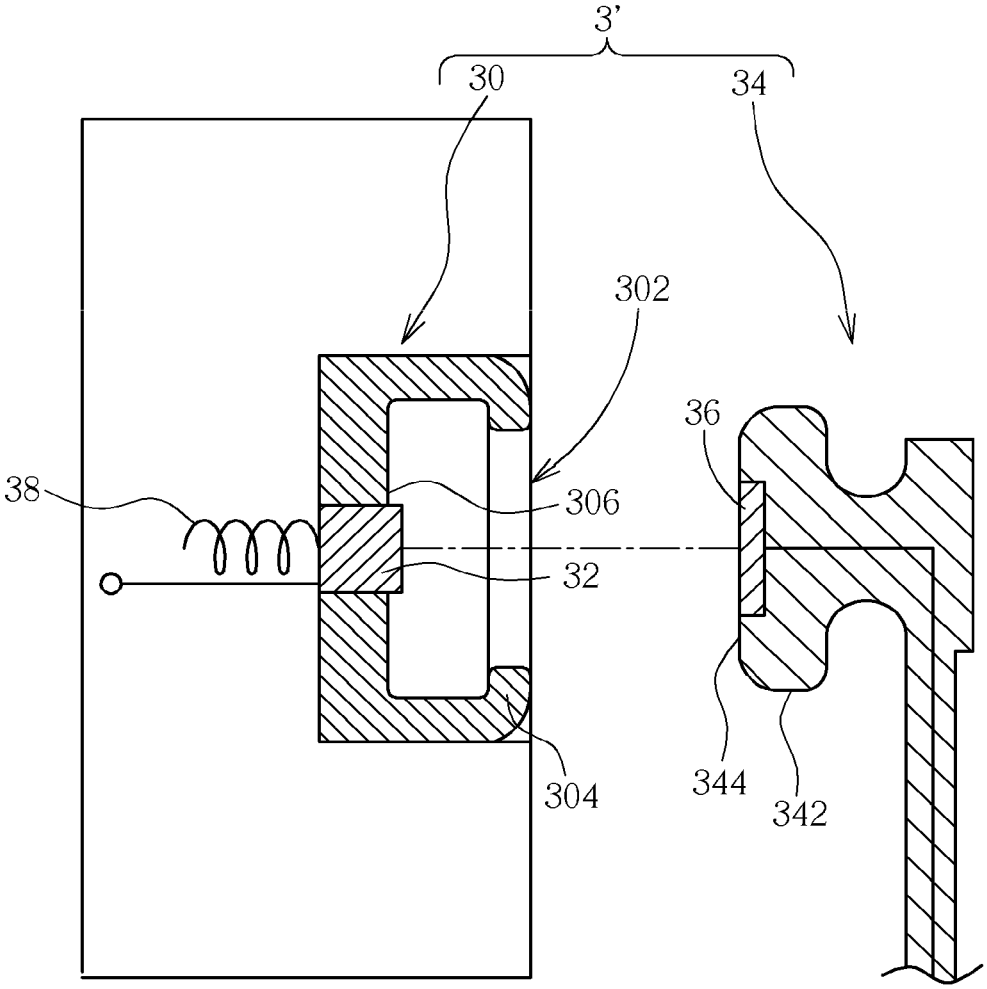
FIG. 6 is a sectional schematic diagram showing a connector module in a third embodiment.

FIG. 6 is a sectional schematic diagram showing a connector module 3' in a third embodiment. The main difference between the connector module 3' and the connector module 3 is that the connector module 3' further includes an abutting element 38 connected to and abutted against the first electrode 32. The first electrode 32 is movably disposed at the bottom 306 of the plug hole 302. When the connecting portion 342 is disposed in the plug hole 302 and presses the first electrode 32, the abutting element 38 provides an elastic force to push the first electrode 32 towards the second electrode 36, so as to ensure the contact between the first electrode 32 and the second electrode 36. In practical usage, the abutting element 38 may be a spring, which is not limited herein.

Figure 7:
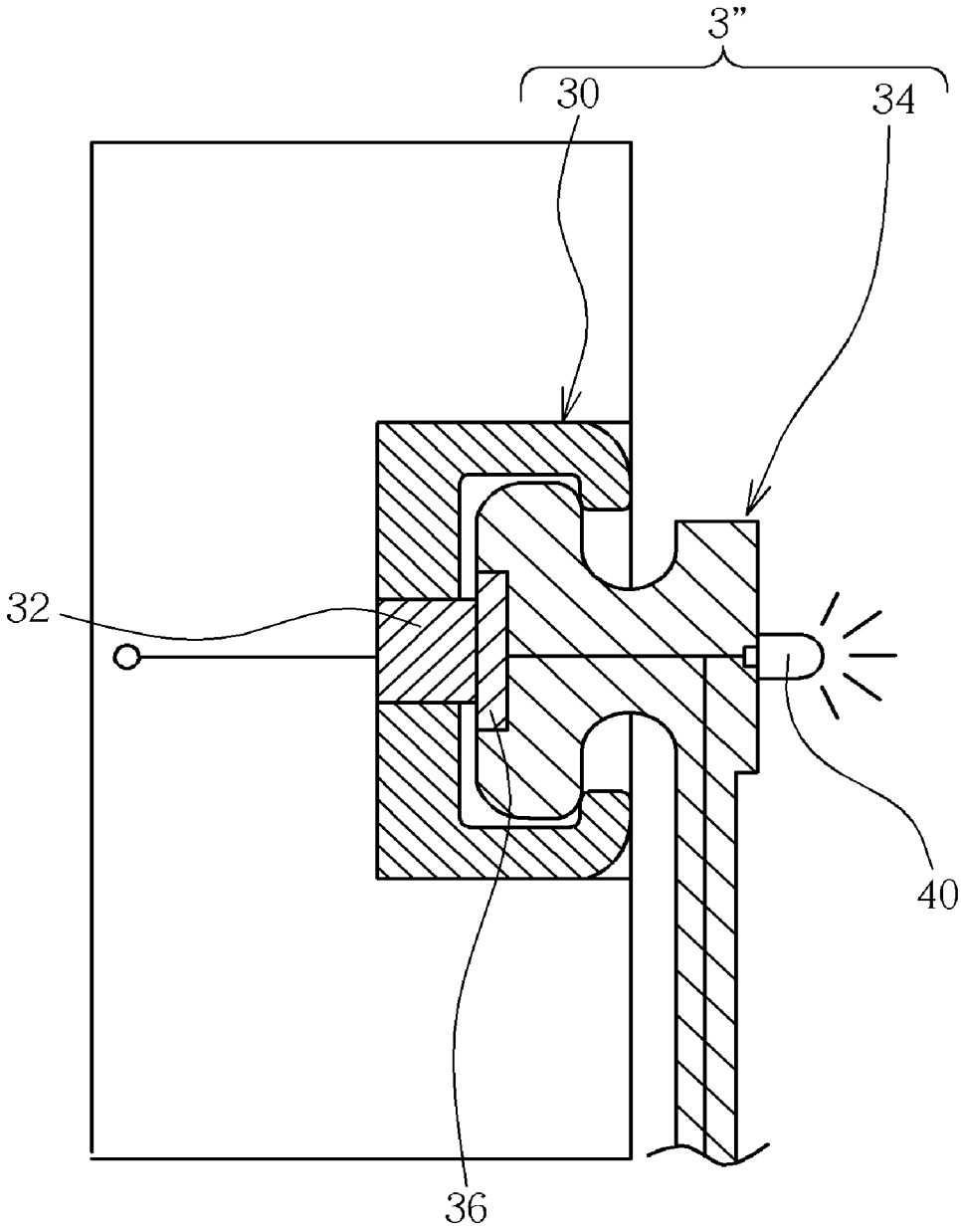
FIG. 7 is a sectional schematic diagram showing a connector module in a fourth embodiment.

FIG. 7 is a sectional schematic diagram showing a connector module 3" in a fourth embodiment. The main difference between the connector module 3" and the connector module 3 is that the connector module 3" further includes a light emitting unit 40 disposed at the second connector 34. When the first electrode 32 is electrically connected to the second electrode 36, the light emitting unit 40 lights up to remind the user. In practical usage, the light emitting unit 40 may be a light emitting diode (LED), which is not limited herein. The signal control of the first electrode 32, the second electrode 36 and the light emitting unit 40 can be achieved by a circuit, which is omitted herein.

Figure 8:
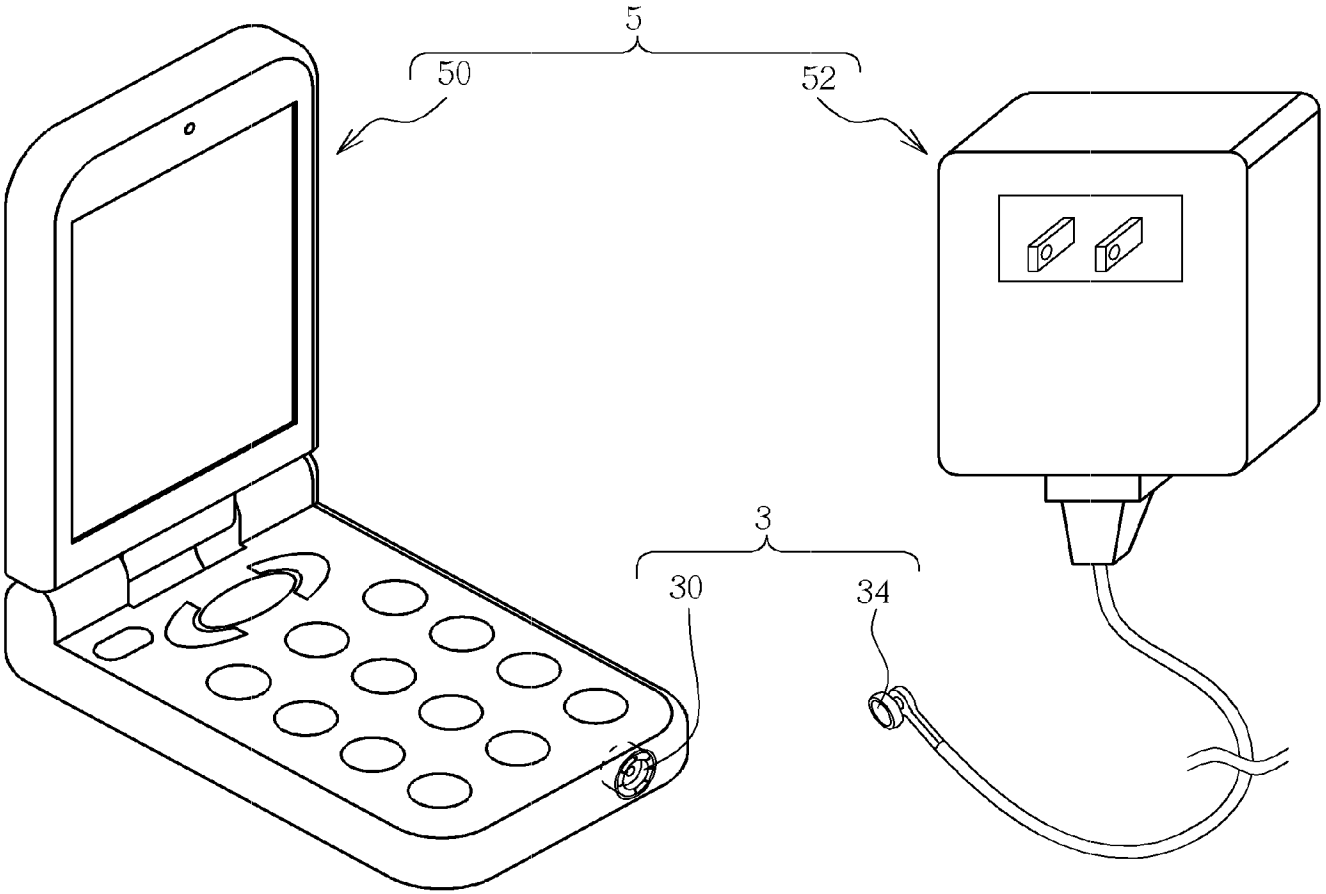
FIG. 8 is a schematic diagram showing an electronic device in a first embodiment.

FIG. 8 is a schematic diagram showing an electronic device 5 in a first embodiment. The electronic device 5 includes a host 50, a power adaptor 52 and the connector module 3. The first connector 30 is disposed at the host 50, and the second connector 34 is disposed at the power adaptor 52. The structure and operation principle of the first connector 30 and the second connector 34 are stated above, which is omitted herein.

Figure 9:
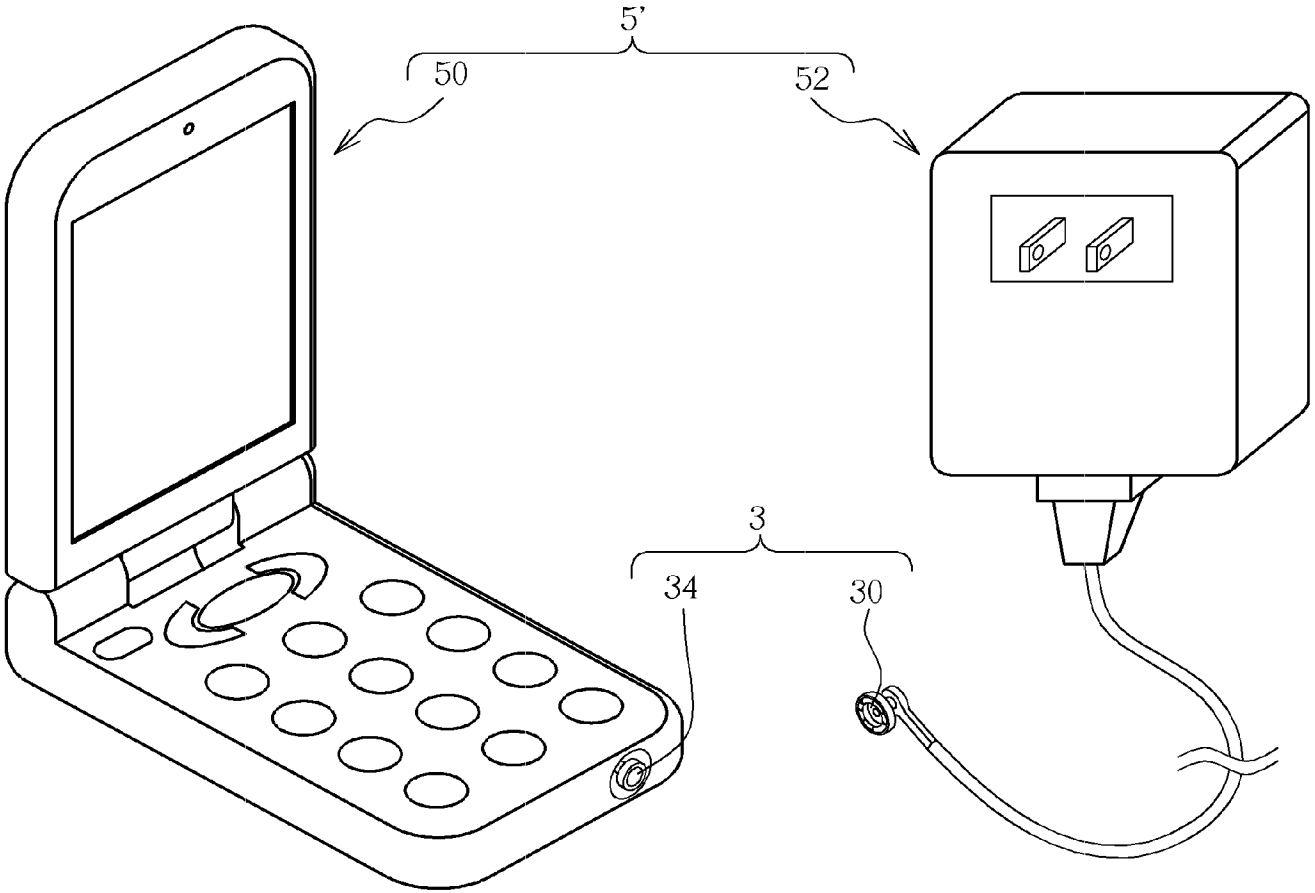
FIG. 9 is a schematic diagram showing an electronic device in a second embodiment.

FIG. 9 is a schematic diagram showing an electronic device 5' in a second embodiment. The main difference between the electronic device 5' and the electronic device 5 is that the first connector 30 is disposed at the power adaptor 52, and the second connector 34 is disposed at the host 50. The structure and operation principle of the first connector 30 and the second connector 34 are stated above, which is omitted herein.

In sum, the second connector is abutted against the edge of the first connector in any angle, and when an external force is applied to the second connector towards the first connector, the edge of the first connector is stretched by the second connector and elastically expands, so that the second connector can be pushed into the first connector. After the second connector is pushed into the first connector, the second connector can rotate for 360 degrees relative to the first connector. After the second connector is pushed into the first connector, if the second connector is pulled out in any angle relative to the first connector, the edge of the first connector is stretched by the second connector and elastically expands to make the second connector detached from the first connector.

Although the present invention has been described in considerable detail with reference to certain preferred embodiments thereof, the disclosure is not for limiting the scope.

Persons having ordinary skill in the art may make various modifications and changes without departing from the scope. Therefore, the scope of the appended claims should not be limited to the description of the preferred embodiments described above.

What is claimed is:

1. A connector module, comprising:

a first connector including a plug hole;

a first electrode disposed in the plug hole;

a second connector including a connecting portion, wherein a projecting area of the connecting portion is larger than that of the plug hole;

a second electrode disposed at the connecting portion; and a light emitting unit disposed at the second connector, and when the first electrode is electrically connected to the second electrode, the light emitting unit turns on;

wherein when the connecting portion of the second connector is disposed in the first connector, the first electrode contacts the second electrode, and an inner wall of the plug hole restrains the connecting portion from detaching from the plug hole.

2. The connector module according to claim 1, wherein the first connector includes a plurality of elastic elements, and the plug hole is surrounded by the elastic elements.

3. The connector module according to claim 1, wherein the connector module further includes an abutting element connected to and abutted against the first electrode, the first electrode is movably disposed at bottom of the plug hole, and when the first electrode is pressed, the abutting element provides an elastic force to the first electrode.

4. An electronic device, comprising:

a host;

a power adaptor;

a first connector selectively disposed at one of the host and the power adaptor, wherein the first connector includes a plug hole;

a first electrode disposed in the plug hole;

a second connector selectively disposed at the other one of the host and the power adaptor, wherein the second connector includes a connecting portion, and a projecting area of the connecting portion is larger than that of the plug hole;

a second electrode disposed at the connecting portion; and a light emitting unit disposed at the second connector, and when the first electrode is electrically connected to the second electrode, the light emitting unit turns on;

wherein when the connecting portion of the second connector is disposed in the first connector, the first electrode contacts the second electrode, and an inner wall of the plug hole restrains the connecting portion from detaching from the plug hole.

5. The electronic device according to claim 4, wherein the first connector includes a plurality of elastic elements, and the plug hole is surrounded by the elastic elements.

6. The electronic device according to claim 4, wherein the electronic device further includes an abutting element connected to and abutted against the first electrode, the first electrode is movably disposed at bottom of the plug hole, and when the first electrode is pressed, the abutting element provides an elastic force to the first electrode.

* * * * *